US005271507A

United States Patent [19]

Evans, Jr.

[11] Patent Number: 5,271,507

[45] Date of Patent: Dec. 21, 1993

[54] STORAGE DISPOSAL SYSTEM FOR RECYCLABLE WASTE PRODUCTS

[76] Inventor: Edward P. Evans, Jr., 149 Mattix Run, Absecon, N.J. 08201

[21] Appl. No.: 962,283

[22] Filed: Oct. 16, 1992

[51] Int. Cl.[5] ..... B07C 9/00

[52] U.S. Cl. ..... 209/657; 209/930; 209/942

[58] Field of Search ..... 209/655, 657, 930, 942, 209/906

[56] References Cited

U.S. PATENT DOCUMENTS

| | | | |
|---|---|---|---|
| 2,901,105 | 8/1959 | Harder | 209/657 X |
| 3,024,906 | 3/1962 | Jaensch | 209/655 X |
| 3,040,887 | 6/1962 | Cornelison | 209/657 X |
| 3,534,853 | 10/1970 | Seaman | 209/655 X |
| 3,661,255 | 5/1972 | Toth | 209/655 |
| 4,013,551 | 3/1977 | DeFeudis | 209/930 X |
| 4,987,988 | 1/1991 | Messina et al. | 209/655 X |
| 5,031,829 | 7/1991 | Shantzis . | |
| 5,083,704 | 1/1992 | Rounthwaite | 209/942 X |

FOREIGN PATENT DOCUMENTS 9008714 8/1990 World Int. Prop. O. ..... 209/655

OTHER PUBLICATIONS

Tucker Housewares, Inc., Product Brochure, "Recycling System", Jan. 1991.

*Primary Examiner*—D. Glenn Dayoan

*Attorney, Agent, or Firm*—Norman St. Landau

[57] ABSTRACT

A waste disposal system wherein a control panel inside a building activates a series of spring loaded diverters which cooperate with a duct leading to a series of bins. Operator means is electrically connected to the control panel. When a user depresses a preselected contact means on the control panel, the diverter connected to it changes its position so as to allow access to a corresponding bin. The user can access different bins for separately storing cans, bottles, paper products, general trash and the like. The present system allows easy access to various bins, and encourages recycling by each householder.

7 Claims, 2 Drawing Sheets

STORAGE DISPOSAL SYSTEM FOR RECYCLABLE WASTE PRODUCTS

This invention relates to a system for the separation and storage of household recyclable waste products. More particularly, this invention relates to a recyclable storage . system for use in multi-unit buildings and residential dwellings.

BACKGROUND OF THE DISCLOSURE

With the current severe limitations on landfills for household waste products, and even their closing, many communities have turned to recycling of various materials to decrease the type and amount of waste materials that are sent to landfills. These communities now separately collect items such as newspapers and other paper products, cans, glass and plastic containers in addition to collecting general household waste products. Thus these materials must be separated by the homeowner and separately stored for pickup. Most homeowners presently do this by having a series of containers on the ground floor or garage. When loaded these containers generally must be hauled to curbside at designated times in accordance with scheduled pick ups.

Household dwellings and dwellings that are multilevel, such as condominiums, apartment houses and the like, and even homes that have kitchen areas on an upper floor, do not have convenient access to ground floor storage areas, and must separately store these items indoors, and carry them downstairs and/or through the dwelling, and to the curb. These are an added burden on the homeowner, and discourage some from complying with separation of waste materials. When several homeowners use the same facilities, such as an open outdoor storage area containing bins or dumpsters, other problems can arise, such as unpleasant odors arising from unclean containers, and wild animals and rats rummaging through the containers.

Thus a system for separating and storing waste products and recyclables without the need for separately conveying these items to remote containers, and which provides an enclosed area for storage, would be highly desirable and would encourage proper separation and storage of waste household products.

SUMMARY OF THE INVENTION

The present invention provides convenient and easy separation of household waste products that allows a homeowner access to an outside storage from the interior of a dwelling.

The present waste disposal system comprises a) a plurality of bins mounted on a plurality of platforms fitted with a spring-loaded diverter that prevents access to said bin when in a first position and that provides access to said bin when in a second position, each diverter fitted with an operator means for changing its position in response to an electrical contact;

b) a duct leading from an opening in the interior building wall to said bins;

c) a receiving unit comprising a pivotable door that operates together with a selected diverter; and d) a control panel mounted on an interior wall of a building having means of connecting a plurality of contact means in said control panel to each of said diverter operator means that change the position of a diverter with respect to said duct.

DETAILED DESCRIPTION OF THE INVENTION

Figure 1:
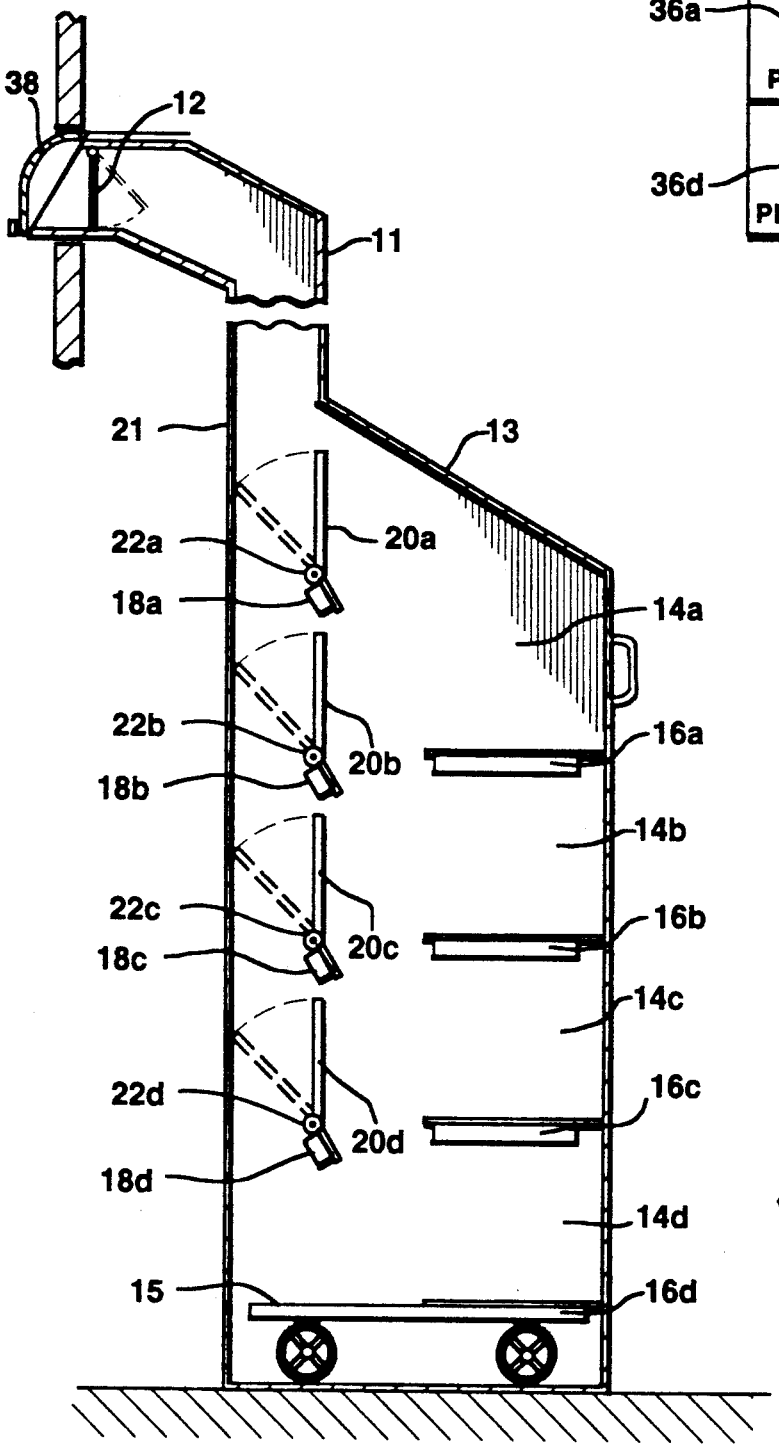
FIG. 1 is a side view of a system of the present invention (not to scale).

The present system will be described in detail with reference to FIG. 1. FIG. 1 is a side view of one embodiment of the system of the present invention.

A duct 11 connects a wall opening 12 mounted in the wall of a building, such as a dwelling, conveniently in the kitchen where most household waste materials are generated, to an exterior storage container 13. The storage container 13 is fitted with a plurality of platforms 16*a*, 16*b*, 16*c* and 16*d*, which can be shelves or sliders, on which a plurality of bins, 14*a*, 14*b*, 14*c* and 14*d* can be slidably supported. The bins 14 can be pulled in and out on shelves, or the platforms 16 can be a series of sliders which can engage preformed edges of the bins 14. Although the illustrated embodiment shows four sets of bins and platforms, the number can of course vary depending on the needs of the building. Alternatively, the bins 14 can be stackable, eliminating the need for shelves or sliders.

The storage container 13 has a series of diverters 20 mounted therein, each controlling or denying access to a preselected bin 14. The diverters 20*a*, 20*b*, 20*c* and 20*d* are in the form of a door fitted with a spring or hydraulic means 22, in this embodiment to maintain the diverters generally in an upright or perpendicular position with respect to the platforms 16. The diverters 20 are also fitted with operator means 18, which can be a solenoid, motor or hydraulic means that, when engaged by selection means in a wall panel 34, deflects the diverter 20 to a parallel position relative to the ground so that the top edge of the diverter 20 contacts the back wall 21 of the duct 11, thereby preventing access to others of the bins 14. Electrical means, such as wires, (not shown) connect each operator means 18*a*, 18*b*, 18*c* and 18*d*, or motor or hydraulic means, with one of the contact means 36 on the control panel 34.

Figure 2:
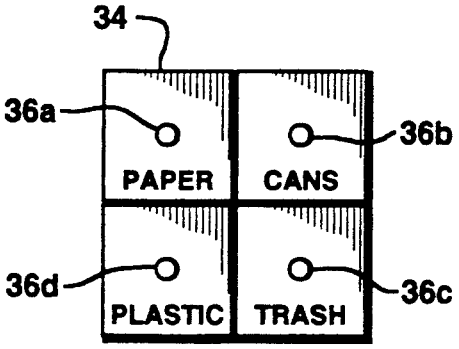
FIG. 2 is a front view of a panel useful in the present system.

FIG. 2 illustrates in detail a front view of a control panel 34 having a plurality of contact means or control buttons 36*a*, 36*b*, 36*c* and 36*d*, which may be labeled for various waste materials, such as "paper", "plastic", "cans" and the like. Each of the control buttons 36*a*, 36*b*, 36*c* and 36*d* is electrically connected to one of the operator means 18. The control panel 34 may be mounted on an interior wall of the building adjacent to the opening 12 into the duct 11 or as is convenient to the home dweller. A diverter door 38, which can conveniently be a roll top-type door, when closed, covers the wall opening 12.

Figure 3A:
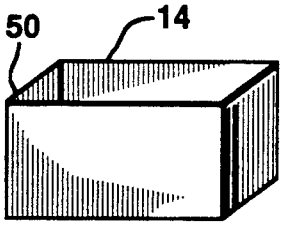
FIGS. 3*a* and 3*b* are side view of alternate bins useful herein.
Figure 3B:
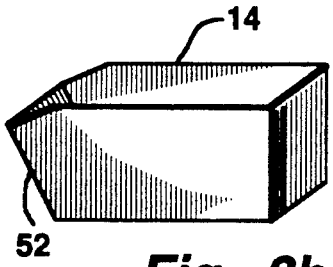

FIG. 3*a* illustrates a suitable bin 14 having an upright back wall 50 and FIG. 3*b* illustrates a suitable bin having a reclining back wall 52. The exact configuration and size of the bin is not part of the invention herein but can be varied to suit the needs of each building.

The present system operates as follows: the user seeking to dispose of a particular type of waste item, opens the interior wall opening door 38, places the waste item inside and pushes the appropriate contact means 36 on the control panel 34. This contact means operates the flap of the opening 12 and the appropriate operator means 18 to deflect the appropriate one of the diverters 20 against the rear wall 21 of the duct 11. The item to be disposed of is then released down the duct 11 and, when it reaches a diverter 20, slides into the appropriate bin 14. When one of the contact means 36 is released, its corresponding operator means 18 is released and the spring means 22 brings the diverter 20 back to its original upright position.

The above description is directed to the simplest embodiment of the present invention, but additional features can be added to further enhance the convenience of the present system for the user, although generally at somewhat higher cost.

A compactor may be installed behind the door 38 through the wall leading to the duct 11 to compact the articles to be disposed of before they pass into the duct 11. This will allow more materials to be stored in each bin 14.

The bins 14 may be separable from the shelves or platforms of the storage container 13 and mounted on a wheeled platform 15 or hand truck. A handle bar (not shown) may be fitted to the front of the platform 15 for wheeling the bins to a pickup site.

Each of the diverters 20 may be fitted with a sensor which can determine when the bin 14 is full. A suitable sensor is a photoelectric cell, which breaks a circuit connected to a light on the control panel to inform a user that the particular bin 14 is full and must be emptied or replaced.

The number of bins generally will be equivalent to the number of different items that must be separated for pickup. This will vary depending on the items recycled by the community. In the event the community has commingled collection, two bins for organic matter and trash may be located in the storage container 13. This obviates the need for the diverters 20*b*, 20*c* and 20*d*. However, a series of bins can be used as hereinabove described, moving to a different bin when a particular bin becomes full.

Figure 4:
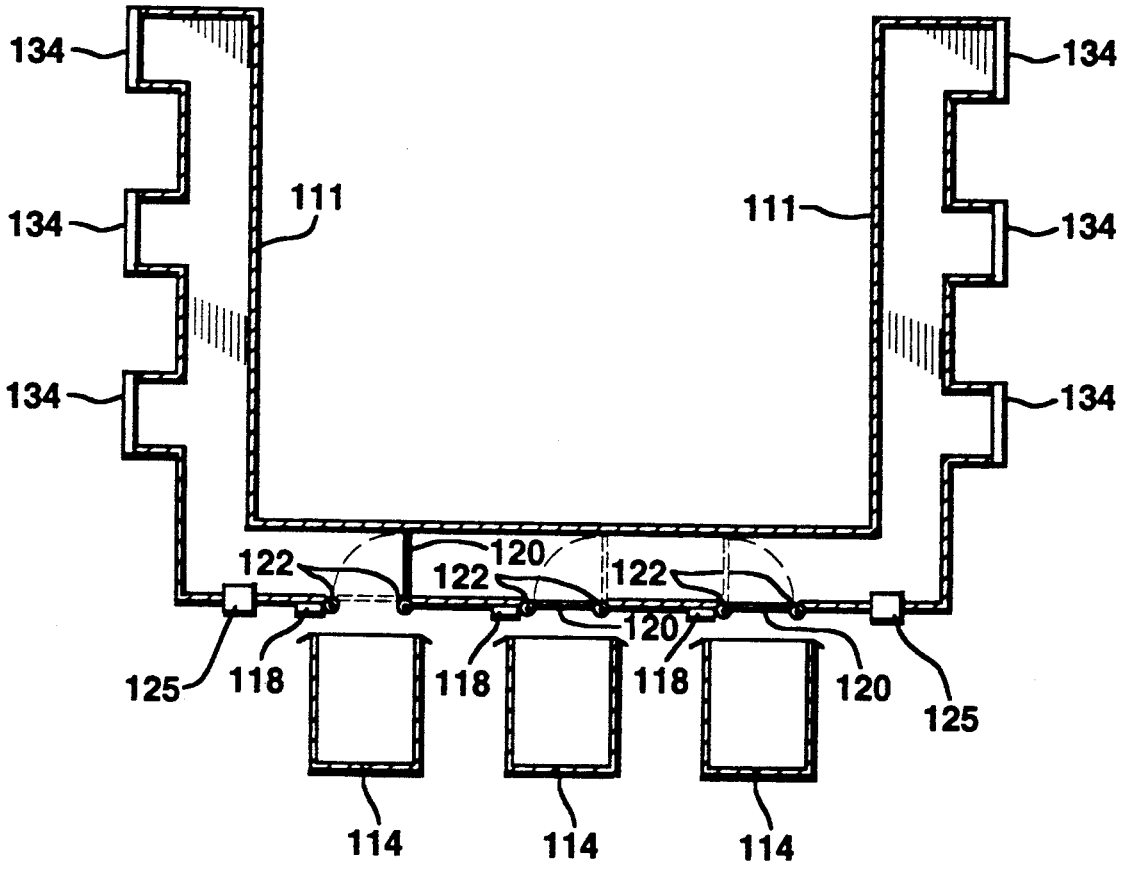
FIG. 4 is a schematic view of an alternate embodiment of a system of the present invention.

FIG. 4 is a schematic view of a more complex system wherein waste products from several dwellings in a building share a common disposal duct system. A series of control panels 134 will be located in each dwelling and empty into a common duct system 111. In this embodiment, a conventional pneumatic vacuum system 125 may be placed in the bottom of the duct 111 to transport the waste materials to a bin 114, in this case located in a remote location outside the building. Such a system can connect to each of several larger bins 114, such as a 55 gallon drum or dumpster. The system of electrical control of diverters for each of the dumpsters from a control panel located in each unit and on each floor is similar to that described hereinabove. The diverters 120 are located in the lower wall of the duct leading to each container. In this case the diverter 120 is normally in a horizontal position covering each of the bins 114. The springs 122 and operator means 118, which can be a solenoid, motor or hydraulic means, operate to move the diverter upward so as to uncover the top of the bins 114 and form a wall extending from a bin 114. The pneumatic vacuum system 125 impels the waste material forward until a diverter 120 is reached which is in a position perpendicular to the bin 114, as selected by the homeowner on his control panel 134. The waste material Will then drop into the appropriate bin 114. When one of the contact means on the control panel 134 is released, its corresponding operator means 118 is also released and spring means 122 brings the diverter 120 back to its original horizontal position.

Although the present invention has been described in terms of specific embodiments, one skilled in the art will readily be able to incorporate various additional features to the system described herein. For example, although the system of the above invention has been described in terms of household waste products, it is apparent that a system as above can be installed in commercial and office buildings as well as in dwellings. These additional features are meant to be included in the present invention, which is only to be limited by the appended claims.

We claim:

1. A waste disposal system comprising a plurality of bins for storage of waste items;

a duct having access to each bin connected to an opening in a wall of a building;

a plurality of spring-loaded diverters, wherein each of said diverters cooperates with a wall of said duct so as to gain access to a particular bin;

operator means mounted on each diverter, said operator electrically connected to a contact means on a control panel located on a wall of said building, the control panel electrically connected to said operator means so that when a particular contact means is engaged, a preselected operator means changes the position of a preselected diverter so that it allows access from the duct to a preselected bin.

2. A system according to claim 1 wherein a compactor is fitted into said duct.

3. A system according to claim 1 wherein indicator means connected to the base of said diverter and said control panel indicates that a particular bin is full.

4. A system according to claim 3 wherein said indicator means is a photoelectric cell.

5. A system according to claim 1 wherein said duct is fitted with pneumatic vacuum means for propelling waste items along said duct.

6. A system according to claim 1 wherein said bins are enclosed in a storage container.

7. A system according to claim 6 wherein said bins are mounted on a wheeled platform.

* * * * *